US009051142B2

(12) United States Patent
Keller

(10) Patent No.: US 9,051,142 B2
(45) Date of Patent: Jun. 9, 2015

(54) APPARATUS FOR SEPARATING INDIVIDUAL FLAT, BENDABLE OBJECTS FROM THE UNDERSIDE OF A STACK OF SUCH OBJECTS

(71) Applicant: Ferag AG, Hinwil (CH)
(72) Inventor: Alex Keller, Rapperswil (CH)
(73) Assignee: FERAG AG, Hinwil (CH)

( * ) Notice: Subject to any disclaimer, the term of this patent is extended or adjusted under 35 U.S.C. 154(b) by 82 days.

(21) Appl. No.: 13/946,278

(22) Filed: Jul. 19, 2013

(65) Prior Publication Data

US 2014/0027970 A1 Jan. 30, 2014

(30) Foreign Application Priority Data

Jul. 27, 2012 (CH) ..... 1182/12

(51) Int. Cl.

| | |
|---|---|
| ***B65H 3/08*** | (2006.01) |
| ***B65H 3/06*** | (2006.01) |
| ***B65H 3/32*** | (2006.01) |
| ***B65H 3/50*** | (2006.01) |

(52) U.S. Cl.

CPC ..... *B65H 3/085* (2013.01); *B65H 2301/42322* (2013.01); *B65H 3/063* (2013.01); *B65H 3/0858* (2013.01); *B65H 3/32* (2013.01); *B65H 3/50* (2013.01); *B65H 2301/4233* (2013.01); *B65H 2301/44714* (2013.01); *B65H 2301/44732* (2013.01); *B65H 2403/512* (2013.01)

(58) Field of Classification Search

CPC ..... B65H 1/00; B65H 1/06; B65H 1/26; B65H 1/263; B65H 3/085; B65H 3/32; B65H 3/36; B65H 3/40; B65H 3/42; B65H 2301/42322; B65H 3/063; B65H 3/50; B65H 2301/44714

USPC ..... 271/90, 91, 99, 101, 102, 106, 112

See application file for complete search history.

(56) References Cited

U.S. PATENT DOCUMENTS

| | | | | |
|---|---|---|---|---|
| 4,637,600 | A * | 1/1987 | Bartimes et al. | 271/93 |
| 5,028,044 | A * | 7/1991 | Fischer | 271/91 |
| 5,050,855 | A * | 9/1991 | Focke et al. | 271/132 |
| 5,535,998 | A * | 7/1996 | Geffert et al. | 271/99 |
| 6,015,145 | A * | 1/2000 | Hartel | 271/98 |
| 6,439,566 | B1 * | 8/2002 | van der Werff | 271/14 |
| 7,384,031 | B2 * | 6/2008 | Noll et al. | 271/101 |
| 7,837,187 | B2 * | 11/2010 | Stauber | 271/11 |
| 2009/0194930 | A1 * | 8/2009 | Stauber | 271/4.09 |

FOREIGN PATENT DOCUMENTS

| | | |
|---|---|---|
| DE | 2110963 | 2/1972 |
| DE | 3905214 | 8/1990 |
| DE | 4432124 | 3/1996 |
| EP | 1254855 | 11/2002 |
| EP | 1334932 | 8/2003 |
| EP | 1748010 | 1/2007 |
| WO | 2007/051324 | 5/2007 |

* cited by examiner

*Primary Examiner* — Prasad Gokhale
(74) *Attorney, Agent, or Firm* — Rankin, Hill & Clark LLP

(57) ABSTRACT

An apparatus for separating individual flat, bendable objects from the underside of a stack of such objects. The apparatus includes a stacking area having a support region, a roller arrangement produced from a plurality of rollers, the roller arrangement supporting the stack from below in the support region, as well as a separating and holding device for separating the objects from the underside of the stack. The rollers of the roller arrangement are guided along a circular path so as to be movable past under the stack in the support region. The apparatus further includes a supporting and stopping device for positioning the supporting and stopping device in a holding position between the stack and the rollers of the roller arrangement.

12 Claims, 3 Drawing Sheets

APPARATUS FOR SEPARATING INDIVIDUAL FLAT, BENDABLE OBJECTS FROM THE UNDERSIDE OF A STACK OF SUCH OBJECTS

BACKGROUND OF THE INVENTION

1. Field of the Invention

The invention is in the area of the conveying of flat, bendable objects, in particular printed products, and relates to an apparatus according to the preamble of the independent Claim. Such an apparatus is disclosed, for example, in WO 2008/000099 A1 and EP 2 128 055 A2.

The apparatus serves for separating individual flat, bendable objects from the underside of a stack of such objects and for the onward conveying of the objects. The apparatus serves, in particular, for separating individual printed products from the underside of a stack of printed products and for the onward conveying of the printed products.

2. Description of Related Art

WO 2008/000099 describes an apparatus for separating individual flat, bendable printed products from the underside of a stack of printed products and for the onward conveying of the printed products. The apparatus includes a stacking area having a support region in which the stack is supported toward the bottom. The apparatus further includes a roller carpet having a plurality of rollers which are freely rotatable about their longitudinal axis, are moved past under the support region along a circular path and at the same time support the printed product stack toward the bottom. The rollers are fastened on a rotatable roller wheel or are coupled to the same for this purpose. In addition, the apparatus includes circulating separating and holding means in the form of suction elements and grippers which cooperate in pairs for separating the objects from the underside of the stack. The rollers are moved past under the stack in the support region in the same direction as the separating and holding means.

The apparatus also includes an onward conveying device for the onward conveying of the separated objects.

The removal of individual printed products occurs by a suction element, which is circulating in the support region, firmly attaching itself from below to the bottom-most printed product and removing the same downward by means of its circular movement. When the printed product is being removed, it is inserted by way of the leading edge into the gripper mouth of a gripper which is circulating in a synchronized cycle in the support region. The gripper grasps the printed product with a closing movement. In the same process step, a following support roller is moved between the underside of the stack and the removed printed product and peels said printed product from the stack during its movement through the support region.

Whilst the suction element is then released from the printed product and is moved away from the same, the circulating, closed gripper conveys the peeled-off printed product further downward toward an onward conveying device and transfers it to the onward conveying device. During this operation, the removed printed product is entrained in part into the inner region of the roller carpet and in this position is entrained a little bit further synchronously with the roller carpet before it is deposited onto the conveyor belt of the onward conveying device.

EP 2 128 055 A2 also describes an apparatus for separating printed products from the underside of a stack of printed products and for the onward conveying of the separated printed products. The apparatus includes a stacking area having a support region in which the stack is supported downward. In addition, the apparatus includes a circulating roller carpet having a plurality of rollers which are freely rotatable about their longitudinal axis, are moved through the support region and, at the same time, support the stack toward the bottom. In addition, the apparatus includes circulating separating and holding means in the form of suction means and grippers for separating the objects from the underside of the stack. The rollers are moved past under the stack in the support region in the same direction as the separating and holding means.

The apparatus also includes an onward conveying device for the onward conveying of the separated objects.

The rollers of the roller carpet are coupled to at least one roller wheel. The coupling is designed according to said embodiment in such a manner that the rollers are pivotable in relation to the roller wheel with their longitudinal axis.

The removal of individual printed products occurs by a suction element, which is circulating in the support region, firmly attaching itself from below to the bottom-most printed product and removing the same downward by means of its circular movement. When the printed product is being removed, it is inserted by way of the leading edge into the gripper mouth of a gripper which is circulating in a synchronized cycle in the support region. The gripper grasps the printed product with a closing movement.

Whilst the suction element is then released from the printed product and is moved away from the same, a following support roller is moved between the underside of the stack and the released printed product and peels the same from the stack during its movement through the support region. The circulating, closed gripper conveys the printed product further downward to an onward conveying device and transfers it to the onward conveying device. Said method steps correspond to the method described in WO 2008/000099. In the case of said operation according to the present embodiment, however, the removed printed product is guided completely into the inner region of the roller carpet.

The rollers, in turn, are pivoted by a control element in a release region of the circular path. This means that an opening, through which the onward conveying device is guided, is created in the roller carpet in the release region.

The printed product, which is conveyed completely into the inner region of the roller carpet by the gripper, is then guided out of the inner region through the opening in the roller carpet outside the region of influence of the rollers and transferred to the onward conveyor belt of the onward conveying device.

The disadvantage of the described apparatuses, however, is that the rollers support the stack of printed products during their movement through the support region only in a local manner, i.e. from point to point, and the linear support region is entrained correspondingly with the rollers through the support region.

If then, for certain reasons no printed products are removed over one or several cycles, i.e. so-called empty cycles are generated with non-occupied grippers, the stack underside can become increasingly curved due to the flexing of the support rollers which roll under the stack. An empty cycle is therefore characterized in that no product is sucked up and the corresponding gripper remains empty.

In the case of empty cycles, it is true that no object is removed from the stack by the suction element and the gripper, but the roller carpet continues to run past under the stack in the circulating direction. As a result of the rollers moving through the support region, the printed products bulge in a downwardly directed bag-like manner between in each case two rollers, which, when viewed over the support region, produces wave-like deformation of the underside of the stack.

Said bulges are moved in each case together with the rollers in a wave-like manner through the support region in the circulating direction of the rollers. The operation connected thereto is called flexing.

Said unwanted effect occurs in particular with thin, not very rigid printed products and leads to mutual displacements of the printed products inside the stack. As a result faults can occur when separating the printed products by, for example, instead of individual printed products being separated off, several printed products are removed at the same time or by products being randomly, i.e. out of cycle, removed from the stack.

The bag-like bulging of the stack of printed products down through between the rollers also occurs on account of gravity when the apparatus is not moving, when the rollers are stationary in the support region. When the operation is resumed, the bulges are moved together with the rollers in a wave-like manner through the support region, which leads to the above-mentioned effect.

BRIEF SUMMARY OF THE INVENTION

Consequently, it is the object of the invention to create an apparatus which serves the same purposes as the apparatuses described in the introduction where, however, no flexing occurs even in the case of very thin printed products, and which consequently allows for as perfect a removal as possible from the stack even in the case of comparatively thin printed products.

Said object is achieved by the apparatus with the features of claim 1. Further preferred embodiments and further developments of the invention proceed from the dependent claims as well as from the description and the figures. The apparatus according to the invention corresponds in particular to a further development of the apparatus disclosed in WO 2008/000099 and EP 2 128 055 A2. In a corresponding manner, the apparatus features described in conjunction with said two disclosure documents are also applicable to the present invention.

The apparatus according to the invention for separating individual flat, bendable objects from the underside of a stack of such objects and for the onward conveying of the separated objects includes according to the claims:

- a stacking area having a support region;
- a roller arrangement produced from a plurality of rollers, said roller arrangement supporting the stack from below in the support region;
- separating and holding means for separating the objects from the underside of the stack in the support region; and
- an onward conveying device for the onward conveying of the separated objects.

In a preferred manner, the separating and holding means are arranged so as to circulate along a circular path. In a preferred manner, the rollers of the roller arrangement are movable past under the stack in the support region. The rollers are preferably moved past under the stack in the same direction as the separating and holding means which circulate below the support region.

In a preferred manner, the rollers extend over a support face in the support region. The support face can be realized as a plane or curved face.

The roller arrangement can be designed for a translatory movement of the rollers in the support region. The translatory movement can be, for example, a movement back and forth.

According to a preferred embodiment of the invention, the rollers are moved along a circular path which leads past the support region. Thus, a plurality of rollers which are spaced apart from one another can be arranged, for example, along the circular path, which rollers form a so-called circulating roller carpet which is moved past under the stack in the support region and supports said stack downward.

The rollers are preferably moved spaced apart from one another at least in the support region.

In a further development of the invention, it is also possible to provide two roller arrangements which are arranged opposite one another and together form the support plane in the support region. In a preferred manner, the two roller arrangements are moved in each case along a circular path. In a preferred manner, the two roller arrangements are realized in a mirror symmetrical manner with respect to one another. It is possible to provide a gap, which is arranged in particular in the centre in the support region between the rollers which are located opposite one another, through which gap, for example, the circulating separating and holding means can be moved. The roller arrangements can be mounted, for example, in each case on a circulating roller wheel.

In a preferred manner, the rollers of the roller arrangement are mounted at least in the support region in each case so as to be freely rotatable about their longitudinal axis. The direction of movement of the rollers through the support region extends transversely with respect to the longitudinal axis of the rollers.

The invention is now characterized in that the apparatus includes a supporting and stopping device for positioning a supporting and stopping means into a holding position between the stack and the rollers of the roller arrangement. I.e. in the holding position the supporting and stopping element lies below the stack. It is preferably in direct contact with the bottom-most object of the stack. The supporting and stopping means which is located in the holding position and the rollers of the roller arrangement lie additionally in the support region in a preferred manner in planes which extend parallel to one another.

In a preferred manner, the supporting and stopping device is arranged laterally of the support region. In a preferred manner, the supporting and stopping device is designed and arranged such that the supporting and stopping means is extended toward the support region substantially in the same direction as the direction of movement of the rollers in the direction of the support region and can be correspondingly retracted out of the support region in the opposite direction to said direction of movement.

In a preferred manner, the supporting and stopping means is a planiform supporting and stopping element. In the holding position, the supporting and stopping means can extend partially or completely over the support region. The support region is defined in an expedient manner by the contact face of the objects. The supporting and stopping means exerts an additional supporting function on the stack along with the rollers. Consequently, it can be viewed as a further support means.

In the holding position, the supporting and stopping means extends along the direction of movement, in particular, when viewed in the circumferential direction of the rollers, in a preferred manner over at least two rollers. I.e. the supporting and stopping means forms a support face over at least one free gap which lies between two rollers. Said support face prevents the objects of the stack sagging between the two rollers. In a preferred manner, the supporting and stopping means extends over several rollers and spans several spaces which are realized by the rollers.

In a preferred manner, the supporting and stopping means is flexible. In particular, the supporting and stopping means can also be resilient.

In addition, the supporting and stopping means can also include an articulated joint which bestows the corresponding flexibility on said supporting and stopping means.

The supporting and stopping means can be realized in one part or in multiple parts, in particular it can have one member or multiple members. In addition, the supporting and stopping means can be constructed with one layer or multiple layers and can include, for example, two, three, four, five or more layers.

The supporting and stopping means can be present in the form of a chain, a belt, a bundle of ties or a strip.

In a preferred manner, the supporting and stopping means is self-supporting, i.e., the supporting and stopping means is not deformed or is only deformed insignificantly as a result of gravity.

The supporting and stopping element can be, for example, of metal, such a spring steel, of plastics material, leather or of a composite substance with several materials. The supporting and stopping means can be, in particular, a metal sheet. In addition, the supporting and stopping element can also be plate-shaped.

In a preferred manner, the supporting and stopping element is constructed in such a manner that said supporting and stopping element comprises a slight amount of static friction toward the stack such that pulling the supporting and stopping element back out of the support region does not result in displacing the objects or in damage to the same.

A multiple-layered supporting and stopping element can additionally comprise a damping layer to reduce the noise. The damping layer can be, for example, of plastics material. The damping layer can be, for example, an outside or inside layer.

According to a preferred further development of the invention, the supporting and stopping element can be strip-shaped. In the holding position, the strip-shaped supporting and stopping element lies at an angle to the longitudinal axis of the rollers, in particular at right angles.

The supporting and stopping device can also include, when viewed in the direction of insertion or transversely with respect to the longitudinal axis, several supporting and stopping elements arranged side by side, in particular parallel side by side. According to said design variant, in a preferred manner the supporting and stopping elements are strip-shaped.

It is also possible to provide several, in particular strip-shaped, supporting and stopping elements which are moved into the support region. They can lie parallel to one another.

The supporting and stopping device also includes an actuating means, in particular pneumatic means, for extending the supporting and stopping means in the direction of the support region. The term "extending" refers to the guiding of the supporting and stopping means into the support region. The actuating means is preferably to be designed also for retracting the supporting and stopping means out of the support region. The term "retracting" refers to the guiding of the supporting and stopping means out of the support region. For example, the retracting can be a withdrawing. In place of pneumatic means, the actuating means can also include hydraulic or electric means for extending and retracting.

As the apparatus according to the invention runs at a comparatively high operating speed, the extending and the retracting of the supporting and stopping element is also effected at a comparatively high speed. Thus, for example, up to 15 objects can be removed from the stack per second. At said speeds, the extending of the supporting and stopping element in the direction of the support region is similar rather to an injection in the direction of the support region. The synchronized cycle movement of the supporting and stopping element is all the more important here for the operation to separate the objects.

In an expedient manner, the actuating means is actuated by means of a control device. The control device can be a central control device which also controls the operation of the apparatus.

In a preferred manner, as already mentioned, the actuating means is actuated in a synchronized cycle with the operation of the apparatus. In this way, the extending of the supporting and stopping means in the direction of the support region can be synchronized with an approaching empty cycle in which no object is removed, or with a shut-down of the apparatus. In addition, in this way the withdrawing of the supporting and stopping means out of the support region can also be coordinated with the first cycle by way of which an object is removed from the stack.

The longitudinal axes of the rollers extend in the support region, i.e. in the region of the stack where they support the stack toward the bottom, preferably parallel to the underside of the stack. As a rule, the longitudinal axes of the rollers extend horizontally or slightly inclined in the support region.

In a preferred manner, the rollers of the roller arrangement are coupled to at least one circulating roller wheel. The coupling of the rollers to a circulating roller wheel allows for simple construction of the apparatus and reliable guiding of the roller arrangement along its circular path.

The separating and holding means are preferably arranged on a circulating carrier wheel. In a preferred manner, the carrier wheel and the roller wheel have the same circular direction. In a preferred manner, the roller wheel and the carrier wheel comprise parallel axes of rotation.

In a preferred manner, the releasing and holding means include at least one suction element and at least one gripper. The suction element and the gripper cooperate in each case in pairs.

The removing or separating of individual objects, in particular printed products, occurs by the suction element, which circulates in the support region, firmly attaching itself from below to the bottom-most object and removing the same downward by means of its circular movement. When the object is being removed, it is inserted by way of the leading edge into the gripper mouth of a gripper which is circulating in a synchronized cycle in the support region. The gripper grasps the object with a closing movement. In the same process step, a following support roller is moved between the underside of the stack and the separated object and peels the same off the stack during its movement through the support region.

Whilst the suction element is then released from the object and is moved away from the same, the circulating, closed gripper conveys the peeled-off object further downward toward an onward conveying device and transfers it to the onward conveying device. During this operation, the removed object is entrained in part or completely into the inner region of the roller arrangement and in this position is entrained a little bit further in a synchronous manner with the roller carpet before then being transferred to an onward conveying device.

According to a preferred embodiment of the invention, the rollers are coupled to the roller wheel in such a manner that they are pivotable with their longitudinal axes in each case with reference to the roller wheel. The rollers, in this connection, are pivotable in a release region along the circular path by means of a control element. I.e. the roller arrangement is pivoted up in the release region. In this case, the onward conveying device is guided by the pivoted-up roller arrangement.

According to said embodiment, the releasing and holding means move the objects in the support region into an inner region of the roller arrangement completely by means of the moving roller arrangement. The roller arrangement is pivoted up in a release region, which is arranged in the direction of circulation of the rollers and in which the objects leave the inner region again, for the onward conveying of the objects.

The pivoting of the roller in the release region occurs preferably by means of a fixed link guiding means, e.g. in the form of a control runner. The rollers roll, for example, off the control runner. In this case, use is made of the fact that the rollers are mounted so as to be freely rotatable about their longitudinal axes in a roller carrier. Thus, it is possible to use a rigid link guiding means without any further movable control elements. The link guiding means is preferably arranged in the interior of the circular path and presses on the rollers or rather the roller arrangement from the inside. As an alternative to this, however, the rollers can also be lengthened toward the back beyond the roller carrier such that the rear ends of the rollers are pressed toward one another by a link guide means, which is arranged outside the roller arrangement, and thus their front ends are moved apart. Other mechanical, pneumatic, hydraulic or electric actuating means can also be used for pivoting the rollers. The roller carriers are preferably mounted on the roller wheel so as to be pivotable about a pivot axis.

According to a further development of the apparatus according to the invention, said apparatus comprises two roller wheels located opposite one another with roller sets which face one another and are preferably symmetrical with respect to one another. The axes of the two roller wheels are preferably coaxial, but can also be inclined, for example, toward the interior of the apparatus. In certain applications, however, it can also be expedient to have only one single roller wheel.

In a preferred embodiment of the invention, the at least one roller wheel and the carrier wheel of the suction means and the gripper comprise parallel axes of rotation, as a result of which simple design is possible. In addition, the carrier wheel and the at least one roller wheel are preferably driven in a rotating manner at the same angular speeds, preferably by the same driving means and coupled together by a gearing unit.

The apparatus according to the invention can be developed as a feeder unit which is, for example, movable. Such a feeder unit is designed, for example, to be refilled with objects manually by personnel.

However, the apparatus according to the invention can also be incorporated in a conveying or processing system, the objects being supplied to the stack individually or in groups by means of device parts connected upstream and the stack serving, for example, as a buffer.

During the operation of the apparatus, objects are removed from the stack in a predetermined cycle.

The removed objects can be deposited and conveyed onward on the conveyor belt of an onward conveying device individually or as a stream.

Where at least one empty cycle occurs or where the apparatus is taken out of operation, a supporting and stopping means is then positioned (beforehand) in the support region between the stack and the roller arrangement.

This occurs preferably by the supporting and stopping means being inserted between two rollers in the direction of the support region below the support region. The supporting and stopping means inserted between the rollers is moved by the rollers in the circulating direction of the rollers toward the support region and is positioned in the support region between the stack and the roller arrangement.

The solution according to the invention allows the problems of flexing on the underside of the stack to be eliminated with little expenditure and little technical means. The supporting and stopping element inserted into the support region prevents the objects from bulging through between the rollers of the roller arrangement and consequently a flexing inside the stack.

The solution according to the invention also protects the objects to be processed. This is achieved by the supporting and stopping means not being extended directly between the rollers and the stack by the actuating means. Rather, the supporting and stopping means is extended between the rollers below the support region and outside the contact region with the stack and is entrained by the rollers following from below in the direction of the support region and is positioned below the stack.

The solution according to the invention also comprises the advantage that existing apparatuses, such as those disclosed in WO 2008/000099 A1 and EP 2 128 055 A2, are able to be fitted in retro with the supporting and stopping device according to the invention.

BRIEF DESCRIPTION OF THE DRAWINGS

The object of the invention is explained below in detail by way of preferred exemplary embodiments which are shown in the accompanying drawings, in which, in each case in a schematic representation.

In principle, identical parts in the Figures are provided with identical references.

DETAILED DESCRIPTION OF THE INVENTION

Figure 1:
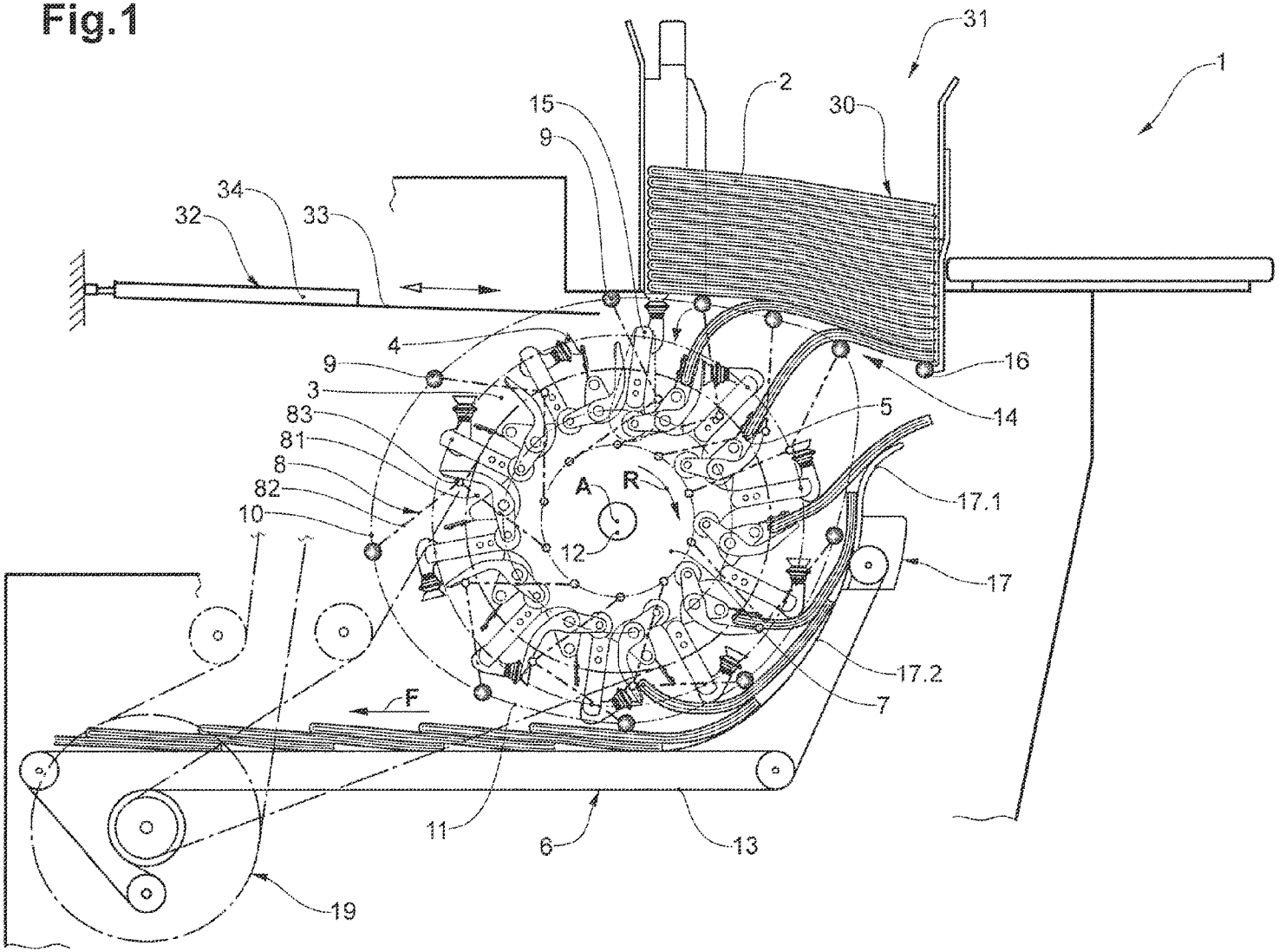
FIG. 1 is an elevation view of a first embodiment of the apparatus according to the invention.

FIG. 1 shows a first embodiment of the apparatus 1 according to the invention for separating individual flat, bendable objects 2 from a stack 30 of said objects 2 and for the onward conveying of the separated objects 2. FIG. 1 corresponds to a side view with an angle of view parallel to the axis of rotation A of a carrier wheel 3 and roller wheel 7.

The apparatus 1 comprises a stacking area 31 in which flat objects 2 which are bendable at least parallel to the axis of rotation A, in particular printed products, are stacked lying on a roller arrangement in the form of a roller carpet which is yet to be described. A support region 14 is realized in a corresponding manner in the region where the stack 30 rests on the roller carpet.

Below the stacking area 31 is arranged a rotating carrier wheel 3 with suction elements 4 and grippers 5 coupled thereto, which are associated with one another in pairs in such a manner that the axis of rotation A is aligned substantially horizontally and parallel to an edge of the stacked objects 2, and that the suction elements 4 and grippers 5 are moved past under the stack 30 approximately in the centre. An onward conveying device 6 which conveys the objects 2 onward is arranged below the carrier wheel 3.

A roller wheel 7 is arranged coaxially with respect to the carrier wheel 3 and axially at a spacing therefrom, levers 8 being coupled to the periphery of said roller wheel at regular angular spacing. The levers 8 comprise an inner leg 8.1 and an outer leg 8.2 each. The two legs 8.1 and 8.2 are connected together in an articulated manner by means of a joint 8.3 and as a result are pivotable toward each other parallel to the rotational plane of the roller wheel 7. The inner leg 8.1 is connected to the periphery of the roller wheel 7 so as to be pivotable parallel to the rotational plane. The roller 9, which is aligned at right angles to the rotational plane of the roller wheel 7, is mounted so as to be freely rotatable on the distal end of the outer leg 8.2. The rollers 9 or the distal ends of the outer legs 8.2 are guided in a roller guide means 10 (indicated by the dot-dash line), the roller guide means 10 defining the circular path 11 of the rollers 9.

The arrangement of the roller wheel 7, levers 8, rollers 9 and roller guide means 10 can be seen better in FIG. 2.

The carrier wheel 3 and the roller wheel 7 are driven in a rotating manner at identical angular speeds, in the present representation clockwise (direction of rotation R). The suction elements 4 are pivoted toward the edge regions of the stacked objects 2 to be grasped at approximately the 12 o'clock position and the objects 2 are released by the grippers 5 at approximately the 6 o'clock position.

The carrier wheel 3 and the roller wheel 7 are driven in an advantageous manner by an identical driving means 19 by means of a common shaft 12. It is possible, as shown, also to drive the conveyor belt 13 of the onward conveying device 6 by the identical driving means 19.

The apparatus 1 according to FIG. 1 comprises ten suction means/gripper pairs 4/5 and ten rollers 9 in such a manner that each suction means/gripper pair 4/5 has associated therewith a roller 9. The roller 9, which is associated with a suction means/gripper pair 4/5, is moved in the support region 14 following the suction means 4 between the object grasped by the suction means 4 and the next object resting thereon. The roller 9 remains positioned between said two objects 2 as long as the object 2 is held by the suction element 4 or gripper 5.

It is also possible to provide more than or fewer than ten suction means/gripper pairs 4/5 on the carrier wheel. In addition, more than one roller 9 can also be associated with each suction means/gripper pair 4/5.

The suction elements 4 are pivoted during their circulation in a manner known per se by means of corresponding control means in relation to a spoke 15, on which they are mounted. Prior to the 12 o'clock position they are pivoted forward in relation to the direction of rotation R. Approximately at the 12 o'clock position (take-over region), they are pivoted into an approximately radial position for the grasping of the object 2 between consecutive rollers 9 and are then pivoted rearward in relation to the conveying direction for the bending of the grasped edge region against the open mouth of the following gripper 5. As long as the grippers 5 hold an object, the suction means 4 remain in the rearward pivoted position, but after the 6 o'clock position (discharge region) they are once again pivoted into the forward pivoted position in order to be ready again for takeover in the takeover region.

During their circulation, the grippers 5 are closed directly after the 12 o'clock position (takeover region) by means of corresponding control means (not shown) and are opened again approximately at the 6 o'clock position (discharge region).

The circular path of the rollers 9, which is defined by the roller guide means 10, is out-of-round and comprises, in particular, a support region 14 (between the 12 o'clock position and approximately the 2 o'clock position) in which the rollers 9, supporting the stack 30, are conveyed past under said support region. In said support region 14 the roller guide means 10 extends in a substantially straight line or at least with a bending radius which is relevantly greater than a circle which is concentric with respect to the roller wheel 7. As the rollers 9 are to maintain their positions between each two consecutive objects 2, the support region 14 cannot extend as far as up to the end of the stacking area 1. For this reason, it may be advantageous to attach a stationary support roller 16 on the rear side of the stacking area 1.

The distances between the rollers 9 in the support region 14 are relatively small in such a manner that removal openings that are just large enough are present between them at the entrance of the support region 14. Toward the exit of the support region 14, the distances between the rollers 9 are advantageously reduced again so that the stack 30 is well supported. Consequently, the rollers 9 are delayed in relation to the suction means/gripper pair 4/5 which is associated with them and arrive in the following region of the objects 2 separated from the stack 30.

The support region 14 is followed by a conveying region (approximately between the 2 o'clock position and the 6 o'clock position), in which the grippers 5 convey the objects 2 which have been completely separated from the stack, these being advantageously supported by a support means 17 (support 17.1 and support belt 17.2). In said region, the rollers 9 remain positioned between two objects 2 each. This means that following regions of the objects 2 are still located on the outside of the circulating roller carpet. In this case, the distance between the roller 9 and the axis of rotation A is advantageously reduced and the distance between consecutive rollers 9 is enlarged in such a manner that the rollers 9 in the discharge region (6 o'clock position) are still positioned only a little outside the distal ends of the spokes 15, on which the suction elements 4 are attached, and are able to press the object 2 deposited by the gripper 5 where applicable in a central or leading region against the onward conveying device 6. Then follows the return region (approximately between the 6 o'clock position and the 12 o'clock position) in which the rollers 9 are able to be guided radially outward again in such a manner that the suction elements 4 are able to be pivoted around in an unobstructed manner from their rearward pivoted position into their forward pivoted position.

It is not necessary to the apparatus 1 according to the invention for the onward conveying device 6 to connect to the gripper movement at the 6 o'clock position, and it is also not necessary for the onward conveying direction F to be aligned parallel to a tangent on the carrier wheel 3 in the discharge region, as is shown in FIG. 1. It is, for example, also possible to arrange the discharge region at the 3 o'clock position and to align the onward conveying direction in a radial manner. It is equally possible to transfer the objects 2 held by the grippers 5 to a gripper conveyor for onward conveying instead of depositing them on a conveyor belt.

The apparatus then further includes a supporting and stopping device 32 with pneumatic means 34, which include a pneumatic cylinder, as well as a supporting and stopping means 33 in the form of a flat, flexible supporting and stopping element.

The supporting and stopping device 32 serves the purpose of inserting a supporting and stopping element 33 between the stack 30 and the rollers 9 in the case of empty cycles or if the apparatus 1 is switched off. The supporting and stopping element 33 which extends transversely with respect to the rollers 9 prevents the printed products 2 from sagging through between two consecutive rollers 9, as occurs for example by flexing or longer stoppage times of the apparatus 1.

The supporting and stopping device 32 is connected to an apparatus control means such that the extending of the supporting and stopping element 33 into the support region 14 and the retracting of the supporting and stopping element 33 out of the support region 14 is able to be carried out in a synchronized cycle with the movement of the rollers 9 and the suction elements 4 and the grippers 5.

Through control means, the supporting and stopping element 33 is then extendable in the direction of the support region 14 and retractable again out of the same by using the pneumatic cylinder. In place of pneumatic means 34, it is also possible to use hydraulic means with a hydraulic cylinder.

The supporting and stopping device 32 is arranged laterally of the support region 14 such that the supporting and stopping element 33 can be extended laterally in the direction of the support region 14. The supporting and stopping device 32 is arranged laterally in such a manner that the supporting and stopping element 33 is able to be inserted into the support region 14 in the same direction as the direction of movement of the rollers 9 in said support region.

The planiform, flexible supporting and stopping element 33 is inserted below the support region 14 laterally between two consecutive rollers 9. The supporting and stopping element 33 is then entrained by the following roller 9, which is moved in the direction of the support region 14, in the direction of the support region 14 and is guided into the support region 14 below the stack 30. The rollers 9 are moved in a rolling manner below the supporting and stopping element along the support region 14.

Whilst the rollers 9 are moved along their circular path through the support region 14 below the stack 30, the supporting and stopping element 33 pauses in a holding position in the support region 14 below the stack 30 which corresponds to an end position.

If an object 2 is then to be removed again from the stack 30, or if the apparatus is to be put back into operation, the supporting and stopping element 33 is withdrawn again out of the support region 14.

The structural and functional features disclosed in conjunction with the supporting and stopping device 32 are not restricted to the concrete exemplary embodiment, but are applicable in general to an apparatus according to the claims or according to the general part of the description.

Figure 2B:
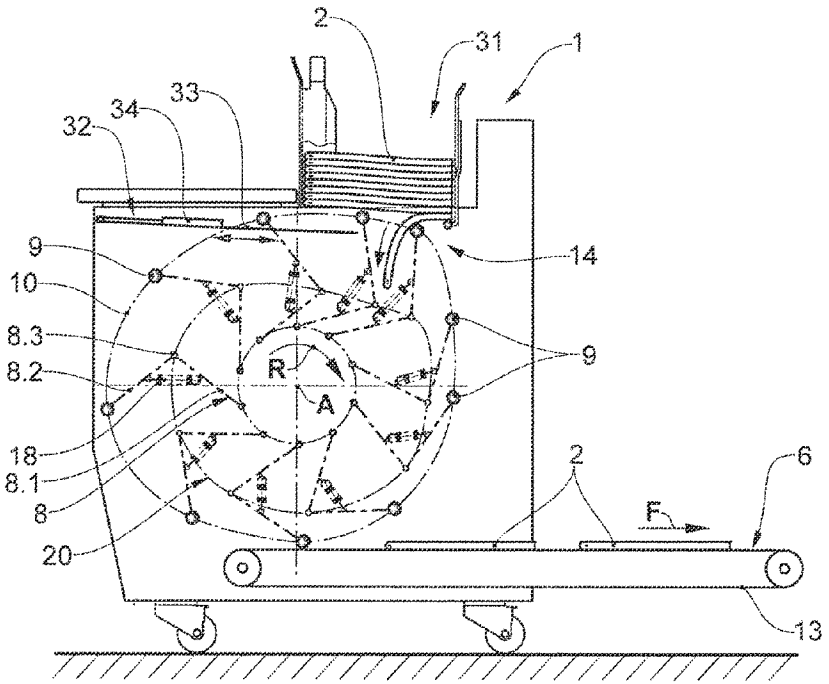
FIGS. 2*a*-2*b* are elevation views of the first embodiment.
Figure 2A:
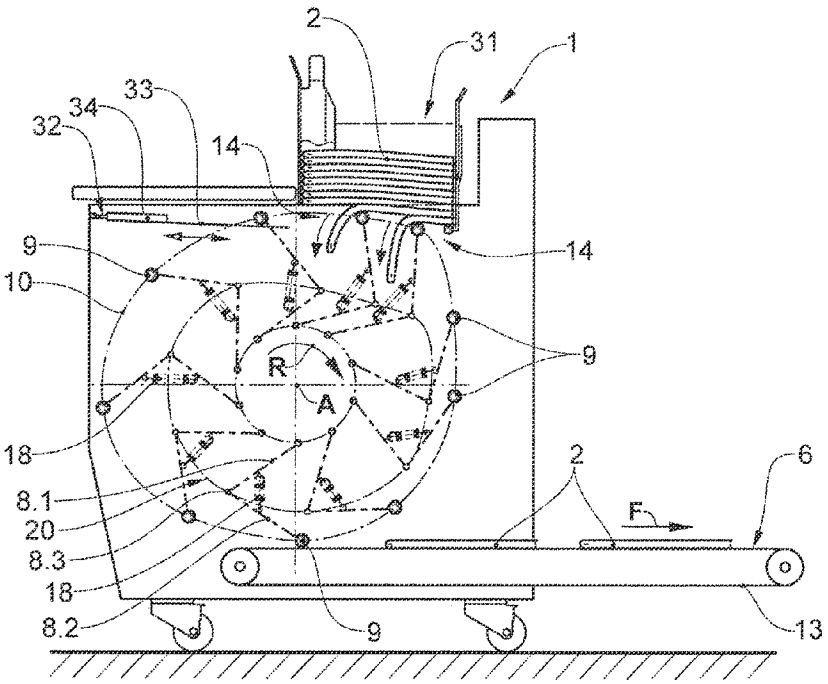

FIGS. 2*a* and 2*b* show an abstracted side view of the first embodiment. The carrier wheel with the suction elements and the grippers is not shown here. As a result, the circular movement of the rollers 9 and of the levers 8 can be seen clearer than in FIG. 1. It can be seen from FIGS. 2*a* and 2*b* that the rollers 9 are held in locally defined positions by means of an additional control means during their circulation which is controlled by the roller guide means 10. The additional control means consists of spring means 18, by means of which the two pivotally interconnected legs 8.1 and 8.2 of each lever 8 are pre-stressed in relation to one another in such a manner that the angle between the two legs is always as small as possible.

As already mentioned further above, it is also possible to pre-stress the legs 8.1 and 8.2 in relation to one another in such a manner that the named angle is always as large as possible. Alternative additional control means, which can be used individually or together, are a joint guide means 20 (indicated by the dot-dash line) in which, for example, the axes of the joints 8.3 or distal ends of the inner legs 8.1 circulate in a guided manner.

The levers 8 shown in FIGS. 1, 2*a* and 2*b* comprise a joint 8.3 which is directed forward in the direction of circulation. This means in other words that the inner legs 8.1 are pushed by the roller wheel 7 and the outer legs 8.2 are pulled by the inner legs 8.1. This is not a condition for the shown embodiment of the apparatus according to the invention. The levers 8 can also be arranged with joints 8.3 which are directed rearward.

The embodiment of the apparatus according to the invention shown in FIGS. 2*a* and 2*b* comprises, in contrast to the embodiment according to FIG. 1, an onward conveying device 6, the conveying direction F of which is opposite to the tangential direction of movement of the grippers in the discharge region.

FIGS. 2*a* and 2*b* also show a supporting and stopping device 32 with pneumatic means 34 and a supporting and stopping element 33 as described above. For further designs for this purpose, reference is made to the relevant description with regard to FIG. 1. FIGS. 2*a* and 2*b* show the supporting and stopping element 33 in different positions when being extended. Thus, FIG. 2*a* shows how the supporting and stopping element 33 is guided, in particular is pushed through between two rollers 9 below the support region 14.

Figure 3:
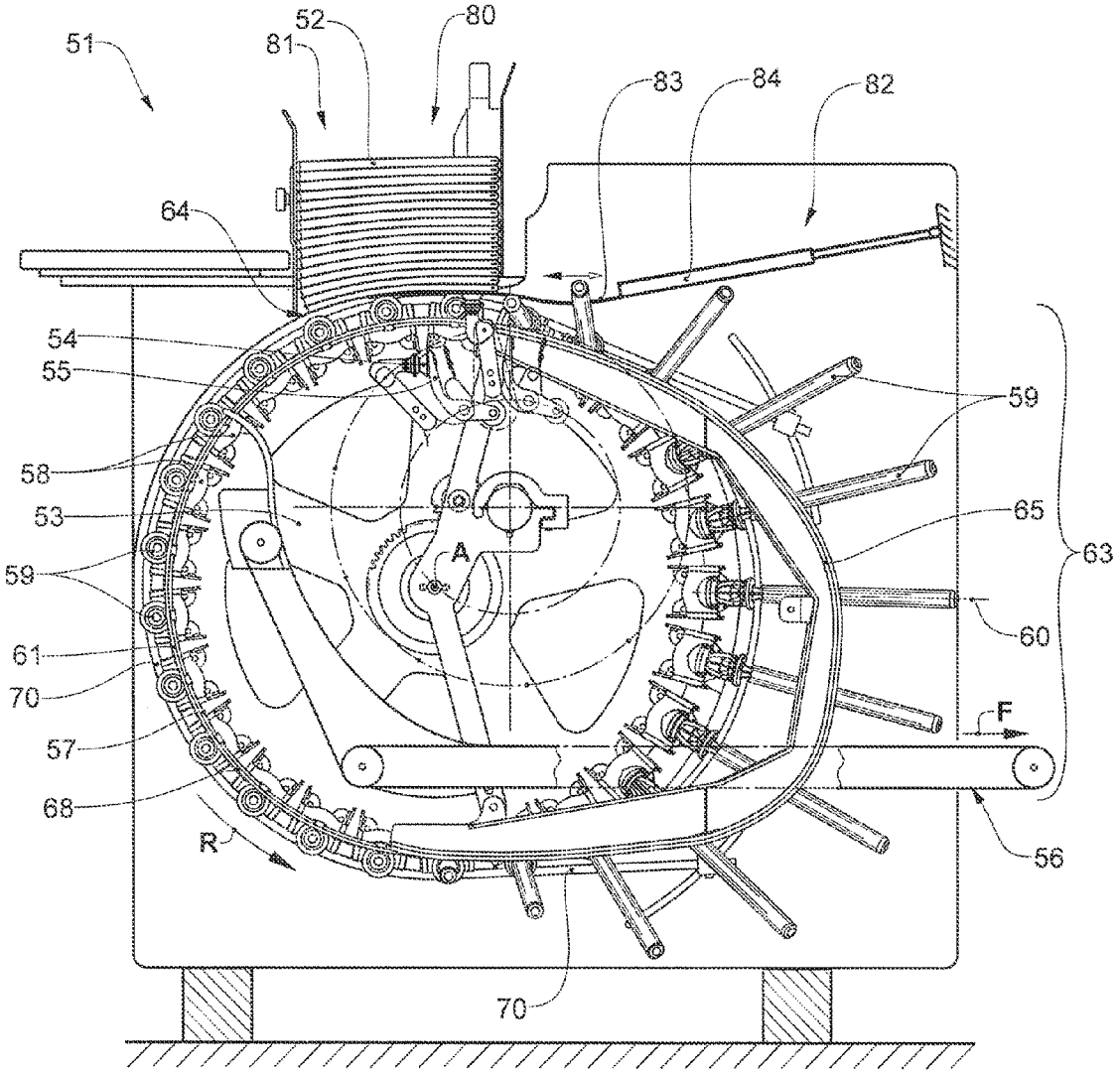
FIG. 3 is an elevation view of a second embodiment of the apparatus according to the invention.

FIG. 3 shows a side view of an apparatus 51 according to the invention, when looking at a plane of a roller wheel 57. A plurality of rollers 59 are each pivotably fastened on the roller wheel 57 by means of a coupling 58. All of the rollers 59 form a roller carpet which circulates along a circular path 61.

In a first region of the circular path 61, the longitudinal axes 60 of the rollers 59 extend parallel to the axis of rotation A of the roller wheel 57 or also at right angles to the drawing plane.

Said first region includes a support region 64 in which flat objects 52, stacked in a stacking area 81 to form a stack 80, rest on the rollers 59. In the first region the rollers 59 roll along a rolling body 70. In the embodiment shown the rolling body 70 is a cable or round belt which is tautened around part of the circular path 61.

In a second region of the circular path 61, referred to below as the release region 63, the rollers 59 are pivoted by a link guide means 65 out of the direction normal with respect to the drawing plane. A pulling means 68, in this case a pull cable, pulls the rollers 59 back into said direction against a stop.

The following elements relate to the conveying of the flat objects 52 by means of the apparatus 51. Only two separating and holding means in each case in the form of a pairing made up of a suction element 54 and a gripper 55 are shown as an example in FIG. 3.

A plurality of such suction elements 54 and grippers 55 (not shown here) run counter clockwise along a circular path, shown in FIG. 3 by a dot-dash line.

According to said embodiment, the apparatus 51 comprises two roller wheels 57 which are situated opposite each other in the direction of the axis of rotation A with roller sets which face one another. The roller sets form a space. The suction elements 54 can be guided against the flat objects 52 in the space between the two roller sets. In this case, in each case a suction element 54 releases one of the flat objects 52 or rather a printed product. A following support roller is moved between the underside of the stack and the released printed product and peels the latter in a careful manner from the stack during its movement through the support region.

In the same process step, a gripper 55 grasps said printed product 52 and moves it between the rollers 59 right through into the interior of the circular path 61.

The gripper 55 then conveys the printed product 52 in a release region 63 to the onward conveying device 56, for example a conveyor belt, and releases the printed product 52. The onward conveying device 56 conveys the printed product 52 in the release region 63 right through the pivoted roller carpet out of the circular path 61.

In addition, the apparatus also includes a supporting and stopping device 82 with pneumatic means 84, which include a pneumatic cylinder, as well as a supporting and stopping means 83 in the form of a planiform, flexible supporting and stopping element.

The supporting and stopping device 82 serves, as mentioned, for the purpose of inserting a supporting and stopping element 83 between the stack 80 and the rollers 59 in the event of empty cycles or if the apparatus is switched off. The supporting and stopping element 83, which extends transversely with respect to the rollers 59, prevents the printed products 52 from bulging through between the rollers 59, as occurs, for example, by flexing or longer stoppage times of the apparatus 51.

The supporting and stopping device 82 is connected to an apparatus control means such that the extending of the supporting and stopping element 83 into the support region 64 and the retracting of the supporting and stopping element 83 out of the support region 64 is able to be carried out in a synchronized cycle with the movement of the rollers 59 and the suction elements 54 and the grippers 55.

By means of control means, the supporting and stopping element 83 is then extendable in the direction of the support region 64 and retractable again out of the same using the pneumatic cylinder. In place of pneumatic means 84, it is also possible to use hydraulic means with a hydraulic cylinder. In addition, an electric linear drive can also be provided for extending and retracting the supporting and stopping element.

The supporting and stopping device 82 is arranged laterally of the support region 64 such that the supporting and stopping element 83 can be extended laterally in the direction of the support region 64. The supporting and stopping device 82 is arranged laterally in such a manner that the supporting and stopping element 83 is able to be inserted into the support region 65 in the same direction as the direction of movement of the rollers 59 in the support region 64.

The planiform supporting and stopping element 83 is rather inserted laterally between two consecutive rollers 59 below the support region 64. The supporting and stopping element 83 is then entrained by the following roller 59, which is moved in the direction of the support region 64, in the direction of the support region 64 and is guided into the support region 64 below the stack 80. As the supporting and stopping element 83 is flexible, it is bent upward by the rollers 59 when being guided up into the support region 64.

Whilst the rollers 59 are moved along their circular path through the support region 64 below the stack 80, the supporting and stopping element 83 pauses in a holding position in the support region 64 below the stack 80, which corresponds to an end position.

If an object 52 is then to be removed again from the stack 80, or if the apparatus is to be put back into operation, the supporting and stopping element 83 is withdrawn again out of the support region 64.

The structural and functional features disclosed in conjunction with said supporting and stopping device 82 are also not restricted to the concrete exemplary embodiment, but are applicable in general to an apparatus according to the claims or according to the general part of the description.

The invention claimed is:

1. An apparatus for separating individual flat, bendable objects from the underside of a stack of such objects and for the onward conveying of the separated objects, said apparatus including:

a stacking area having a support region;

a roller arrangement produced from a plurality of rollers that circulate along a circular path, said roller arrangement supporting the stack from below in the support region and wherein the rollers of the roller arrangement are movable past and under the stack in the support region;

a separating and holding device for separating the objects from the underside of the stack in the support region; and an onward conveying device for the onward conveying of the separated objects;

wherein the apparatus includes a supporting and stopping device having a supporting and stopping means that is positionable in the support region in a holding position between the stack and the rollers of the roller arrangement, said supporting and stopping means being movable along the direction of movement of the rollers toward the support region.

2. The apparatus according to claim 1, wherein the supporting and stopping means is a planiform flexible supporting and stopping element.

3. The apparatus according to claim 1, wherein the supporting and stopping means is a strip-shaped supporting and stopping element.

4. The apparatus according to one of claim 1, wherein the supporting and stopping device includes several supporting and stopping means that are arranged side by side in the insertion direction.

5. The apparatus according to claim 1, wherein the supporting and stopping means is a supporting and stopping element which is realized in one part or multiple parts.

6. The apparatus according to claim 1, wherein the supporting and stopping means is a supporting and stopping element which is realized in one layer or in multiple layers.

7. The apparatus according to claim 1, wherein the supporting and stopping means extends in the holding position in the support region along the roller arrangement over at least two rollers.

8. The apparatus according to claim 1, wherein the supporting and stopping device includes an actuator for extending the supporting and stopping means in a direction of the support region and for retracting the supporting and stopping means out of the support region.

9. The apparatus according to claim 1, wherein the supporting and stopping device is arranged laterally of the support region.

10. A method for operating an apparatus according to claim 1, wherein, during the operation of the apparatus, objects are removed from the stack in a predetermined cycle and when at least one empty cycle occurs or when the apparatus is taken out of operation, the supporting and stopping means is inserted beforehand in the support region between the stack and the roller arrangement.

11. The method according to claim 10, wherein the supporting and stopping means, when viewed along the direction of movement of the rollers, is inserted laterally between two rollers in front of and below the support region, and the supporting and stopping means is guided into the support region between the stack and the roller arrangement by rollers, which are moved along the direction of movement to the support region.

12. The method according to claim 10, wherein when the separation of objects from the stack is resumed subsequent to an empty cycle or an operating interruption, the supporting and stopping means is retracted beforehand out of the support region.

* * * * *